US007067041B2

(12) United States Patent
Tsuura et al.

(10) Patent No.: US 7,067,041 B2
(45) Date of Patent: Jun. 27, 2006

(54) METHOD OF PRODUCING PULP MOLDINGS

(75) Inventors: Tokuo Tsuura, Tochigi (JP); Hiroaki Kobayashi, Tochigi (JP); Kenichi Otani, Tochigi (JP); Masayuki Osaki, Tochigi (JP); Shingo Odajima, Tochigi (JP)

(73) Assignee: Kao Corporation, Tokyo (JP)

( * ) Notice: Subject to any disclaimer, the term of this patent is extended or adjusted under 35 U.S.C. 154(b) by 12 days.

(21) Appl. No.: 10/240,749

(22) PCT Filed: Apr. 6, 2001

(86) PCT No.: PCT/JP01/02997

§ 371 (c)(1),
(2), (4) Date: Mar. 7, 2003

(87) PCT Pub. No.: WO01/77439

PCT Pub. Date: Oct. 18, 2001

(65) Prior Publication Data

US 2003/0150582 A1 Aug. 14, 2003

(30) Foreign Application Priority Data

Apr. 11, 2000 (JP) ..... 2000-109964

(51) Int. Cl.
*D21F 13/00* (2006.01)

(52) U.S. Cl. ..... 162/218; 162/224; 162/226; 162/227; 162/396; 264/322; 264/324

(58) Field of Classification Search ..... 162/218, 162/224, 226, 227, 396; 264/322, 324
See application file for complete search history.

(56) References Cited

U.S. PATENT DOCUMENTS

| | | | | |
|---|---|---|---|---|
| 2,961,043 | A | 11/1960 | Hicks | |
| 6,605,187 | B1 * | 8/2003 | Nonomura et al. | 162/224 |

FOREIGN PATENT DOCUMENTS

| | | | |
|---|---|---|---|
| JP | 35-9669 | | 7/1960 |
| JP | 42-9086 | * | 4/1967 |
| JP | 42-9086 | | 5/1967 |
| JP | 48-50003 | | 7/1973 |

* cited by examiner

*Primary Examiner*—Mark Halpern
(74) *Attorney, Agent, or Firm*—Oblon, Spivak, McClelland, Maier & Neustadt, P.C.

(57) ABSTRACT

A method of producing pulp moldings having a paper-making process comprising the steps of assembling split mold halves (11, 12) having suction passageways (14) to form a paper-making mold (10), feeding pulp slurry of predetermined set feed concentration into the cavity (13) in the paper-making mold (10), and sucking the pulp slurry through the suction passageways (14) to form a pulp layer (15) on the inner surface of the paper-making mold (10), wherein the concentration of the pulp slurry in the cavity (13) in the initial and/or final period of formation of the pulp layer (15) in the paper-making process is lower than the above-mentioned set feed concentration of the pulp slurry.

11 Claims, 4 Drawing Sheets

W
I
II
10
11
12
13
14
15
17
18
19
1
2
3
4

METHOD OF PRODUCING PULP MOLDINGS

This application is a 371 of PCT/JP01/02997 filed 6 Jun. 2001.

TECHNICAL FIELD

The present invention relates to a method of producing a pulp molded article.

BACKGROUND ART

There is a method of producing pulp molded articles which involves a papermaking step comprising feeding a pulp slurry to the cavity of a papermaking mold composed of splits each having suction passageways, and sucking the pulp slurry through the suction passageways to form a pulp layer on the inner side of the papermaking mold. In the papermaking step of this method, when the cavity is not full of the pulp slurry in the initial stage of pulp slurry feeding or after the end of the feeding, the solid component of the pulp slurry such as pulp tends to sink spontaneously due to the insufficient effect of agitation than in the stage where the cavity is sufficiently filled with the pulp slurry and the pulp slurry is sucked through the suction passageways for papermaking. When pulp is sinking, the water content is sucked more easily so that the slurry concentration increases. As a result, there is a tendency that a resulting molded article has a larger thickness in its lower part than in the upper part. The tendency is particularly conspicuous in making hollow molded articles the body of which steeply rises from the bottom, such as bottles and cartons. This has been one of the problems in manufacturing of hollow molded articles.

Accordingly, an object of the present invention is to provide a method of producing a pulp molded article having reduced thickness unevenness in the vertical direction.

DISCLOSURE OF THE INVENTION

The present inventors have found that the thickness unevenness in the vertical direction of a molded article can be reduced by diluting the pulp slurry in the cavity in the initial stage and/or the final stage of pulp layer formation in the papermaking step.

The present invention has been completed based on this finding. That is, the above object is accomplished by providing a method of producing a pulp molded article which includes a papermaking step comprising joining splits each having suction passageways into a papermaking mold, feeding a pulp slurry into the cavity of the papermaking mold, and sucking the pulp slurry through the suction passageways to form a pulp layer on the inner surface of the papermaking mold, wherein a fluid for diluting the pulp slurry is fed into the cavity during the pulp slurry is remaining in the cavity, and the concentration of the pulp slurry in the cavity in the final stage of pulp layer formation in the papermaking step is lowered.

The present invention also accomplishes the above object by providing a method of producing a pulp molded article which includes a papermaking step comprising joining splits each having suction passageways into a papermaking mold, feeding a pulp slurry into the cavity of the papermaking mold, and sucking the pulp slurry through the suction passageways to form a pulp layer on the inner surface of the papermaking mold, wherein at least two pulp slurries of different composition are fed into the cavity, the start of feeding the first pulp slurry of said pulp slurries is followed by feeding the second pulp slurry of said pulp slurries, and a fluid for dilution and agitation is fed into the cavity at least the final pulp slurry of said pulp slurries fed into the cavity is remaining in the cavity.

BEST MODE FOR CARRYING OUT THE INVENTION

The method of producing a pulp molded article (hereinafter simply referred to as a molded article) according to the present invention will be described based on its preferred embodiment with reference to the accompanying drawings.

Figure 1:
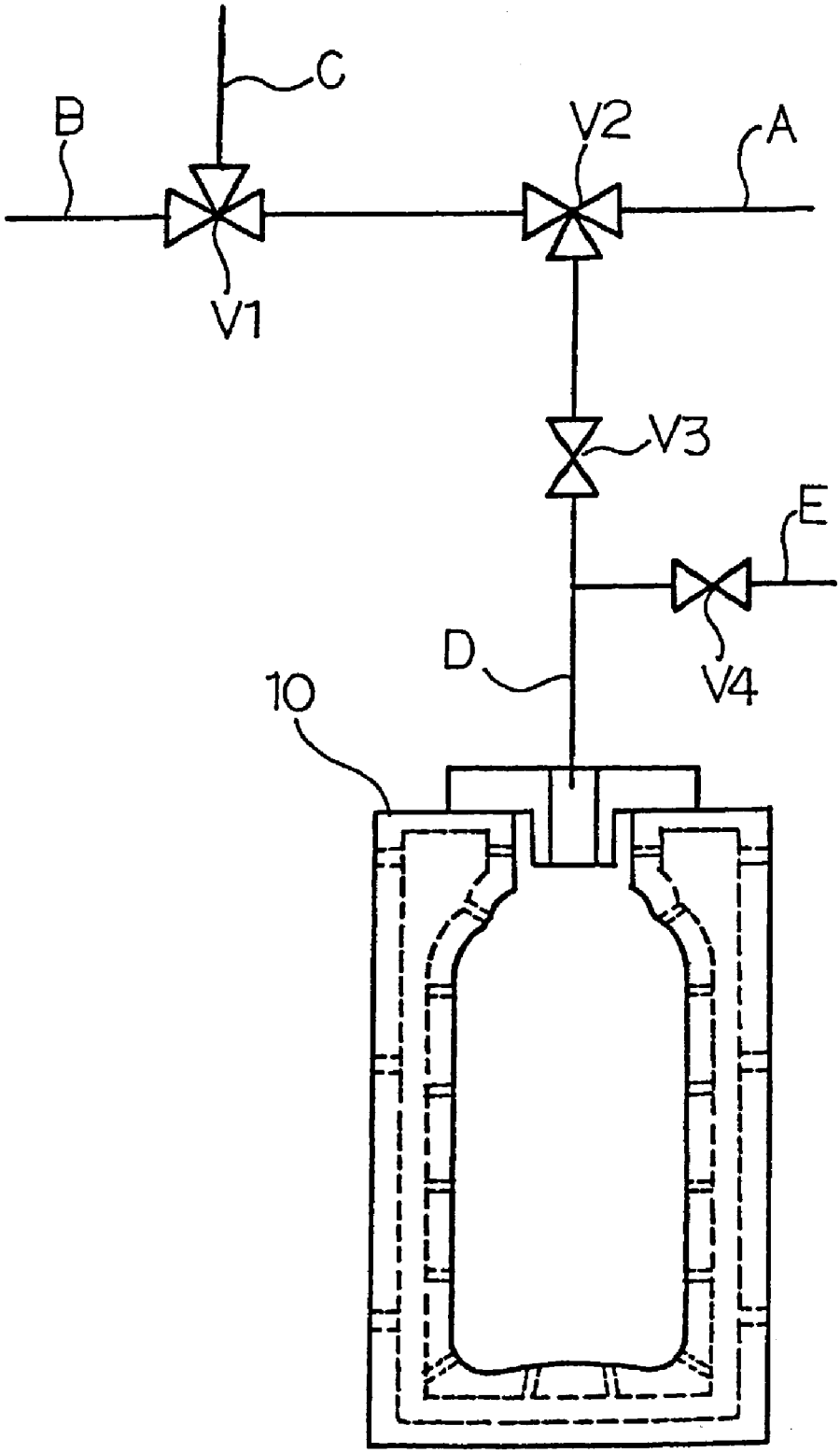
FIG. 1 schematically illustrates a papermaking mold and a pulp slurry feed system use in the papermaking step of the method for producing a molded article according to the present invention.

FIG. 1 schematically illustrates a papermaking mold and a pulp slurry feed system use in the papermaking step of an embodiment of the method for producing a molded article according to the present invention. In the Figure, the papermaking mold is a split mold.

Figures 2A, 2B, 2C, 2D, 2E, 2F, 2G, 2H:
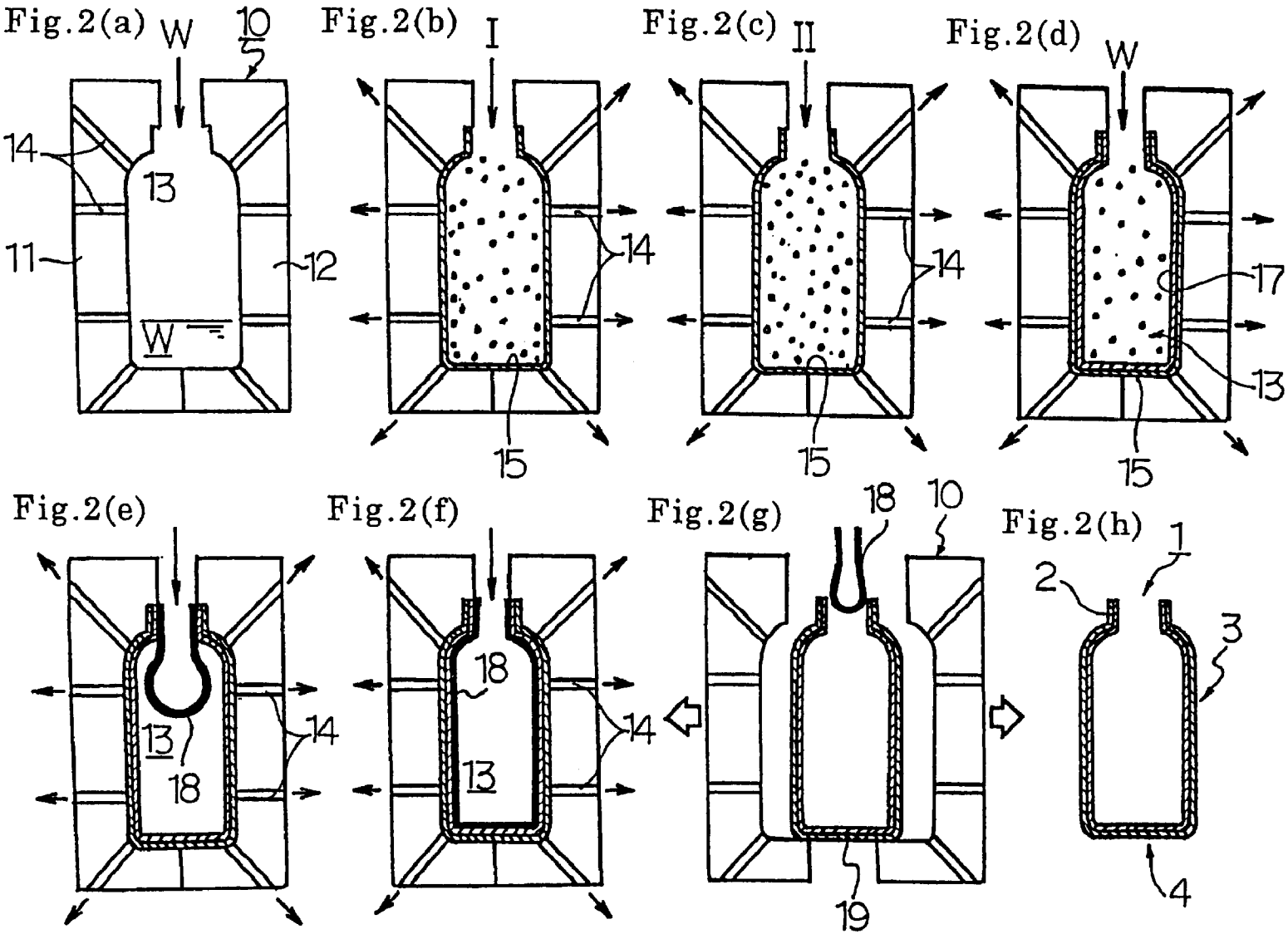
FIGS. 2(*a*) through (*g*) show a schematic flow of an embodiment of the method for producing a pulp molded article according to the present invention, and FIG. 2(*h*) is a schematic of the resulting pulp molded article.

In this embodiment two pulp slurries having different compositions as described below are used to manufacture a molded article. As shown in FIG. 1, the pulp slurry feed system includes two pipe lines A and B for feeding the pulp slurry and also a pipe line C which is for feeding a fluid for pulp slurry dilution described later (hereinafter also referred to as a diluting fluid). The feed system is designed to feed these three kinds of fluids from a common pipe line D through the opening of the papermaking mold. V1 to V4 shown in FIG. 1 arc valves. The system also has a pipe line E for feeding air or steam into the cavity in dewatering of the pulp layer. As shown in FIGS. 2(*a*) and (*b*) the splits 11, 12 each have a plurality of suction passageways 14. The inner surface of each split 11 is covered with a papermaking screen (not shown) having a prescribed opening size.

FIGS. 2(*a*) to (*g*) show the flow of the method for producing a molded article according to this embodiment. (*a*) is the step of injecting a diluting fluid. (*b*) is the step of injecting a first pulp slurry and dewatering. (*c*) is the step of dewatering the first pulp slurry and injecting a second pulp slurry. (*d*) is the step of dewatering the second pulp slurry and injecting water after the injection of the second pulp slurry. (*e*) is the step of inserting a pressing member. (*f*) is the step of pressing and dewatering. (*g*) is the step of removal from the mold.

In the initial stage of pulp layer formation in the papermaking step, the concentration of the pulp slurry in the cavity 13 is made lower than the predetermined concentration of the first pulp slurry to be fed. In the present embodiment, in particular, the concentration of the pulp slurry in the cavity 13 is made lower than the predetermined concentration of the first pulp slurry while the liquid level in the cavity 13 is rising in order to reduce thickness unevenness that may occur in the vertical direction in the initial stage of pulp layer formation.

In the present embodiment, the valves V1 to V4 are operated so as to feed only the diluting fluid from the line C of FIG. 1. Then, as shown in FIG. 2(*a*), the diluting fluid W is injected, i.e., poured under pressure into the cavity 13 through the upper opening of the papermaking mold 10, which is composed of a pair of splits 11 and 12 butted together to form the cavity 13 whose shape agrees with the contour of a molded article to be produced. The diluting fluid W is injected by means of, for example, a pump. The injection pressure of the diluting fluid is preferably 0.01 to 5 MPa, more preferably 0.01 to 3 MPa.

Water is preferably used as the diluting fluid for improved outer appearance of molded articles and easiness of pipe cleaning. Warm water may be used to increase dewatering efficiency. In using warm water, the water temperature is preferably 35 to 90° C., more preferably 45 to 80° C.

It is preferable to use, as a diluting fluid, white water drained from the previously fed pulp slurry, which will reduce the amount of fresh water to be used and the amount of waste liquid.

A pulp slurry which is adjusted low concentration in advance can also be used as the diluting fluid. In this case, the concentration of the pulp slurry as a diluting fluid is preferably 50% or less of that of the pulp slurry fed (predetermined concentration) and is more preferably 1% by weight or less. It is preferred that the concentration of the pulp slurry as a diluting fluid be lowered as the concentration of the pulp slurry to be fed increases.

A detergent or various functionalizing additives may be added in the diluting fluid.

The injection volume of the diluting fluid is decided in consideration of the size and the shape of a molded article to be produced (or the cavity volume) and the first pulp slurry with the predetermined concentration is fed. Where the predetermined concentration of the first pulp slurry is 1% by weight or higher, a preferred injection volume Vw of the diluting fluid is in the range $(1/4)\rho s \cdot Vc < Vw < 8Vc$. The range is calculated from the length of the diluting fluid feed pipe line having the three valves as shown in FIG. 1 and the cavity volume. If the injection volume Vw of the diluting fluid is $(1/4)\rho s \cdot Vc$ or less, the largest thickness to smallest thickness ratio of a molded article would exceed a preferred range of from 1.0 to 3.0, i.e., the pulp layer would suffer from considerable unevenness thickness. In this case, the pulp layer may be scorched in drying process, the drying efficiency is reduced, or the resulting molded article has reduced compressive strength. If the injection volume Vw of the diluting fluid is 8 or more times the cavity volume Vc, a long time is required on to finish of papermaking process. In the above relationship, $\rho s$ is the predetermined concentration (wt %) of the pulp slurry feed, Vc is the volume of the cavity; and Vw is the injection volume of the diluting fluid. More concretely, for instance, the concentration $\rho s$ of the pulp slurry in the cavity before pouring water as a diluting fluid is 2% by weight, and the cavity volume Vc is 1 liter, the injection volume of water Vw is preferably in the range $0.5 < Vw < 8$ liters.

After a predetermined amount of the diluting fluid W is injected, the valves V1 and V2 are operated so that only a first pulp slurry I may be fed from the line A of FIG. 1. As shown in FIG. 2(*b*), the first pulp slurry I is injected to a certain liquid level in the cavity 13. In the present embodiment, since the diluting liquid is supplied before the feed of the first pulp slurry I, the pulp slurry in the cavity 13 is a diluted one. Injection of the first pulp slurry I is performed with, for example, a pump. The injection pressure of the first pulp slurry I is preferably 0.01 to 5 MPa, more preferably 0.01 to 3 MPa.

It is preferable that the first pulp slurry I is injected in the cavity after the supply of the diluting fluid, however, the first pulp slurry I may be injected during, simultaneously with, or before the supply of the diluting fluid by operation of the valve VI. In case of after or simultaneous injection of the first pulp slurry I, the diluting fluid serves as a fluid for dilution and agitation.

The predetermined concentration of the first pulp slurry is preferably 0.1 to 6% by weight, more preferably 0.5 to 3% by weight. At a concentration lower than 0.1% by weight, cases sometimes result in which a uniform thickness is not obtained only to provide a rejective molded article. At a concentration of higher than 6% by weight, an increased amount of the diluting fluid would be required to obtain a desired effect of diluting the pulp slurry in the cavity, which needs an increased time for injecting the diluting fluid. A predetermined concentration of 0.5% by weight or higher is particularly effective to stabilize molding properties, and a predetermined concentration of 3% by weight or lower is particularly effective to level the thickness variation in the vertical direction.

The pulp fiber which can be used in the first pulp slurry includes any kinds that are used in this type of pulp molded articles. In particular, use of specific pulp fiber as described later provides molded articles with specific characteristics described later. The first pulp slurry may contain, in addition to the pulp fiber and water, other components, such as inorganic substances, e.g., talc and kaolinite, inorganic fibers, e.g., glass fiber and carbon fiber, powdered or fibrous thermoplastic synthetic resins, e.g., polyolefins, non-wood or plant fiber, polysaccharides, and so forth. The amount of these other components is preferably 1 to 70% by weight, particularly 5 to 50% by weight, based on the total amount of the pulp fiber and the other components.

As stated above, in the present embodiment of the method of producing a pulp molded article, the pulp slurry concentration in the cavity in the initial stage of pulp layer formation in the papermaking step is lower than the predetermined concentration of the first pulp slurry feed. The term "initial stage" of pulp layer formation in the papermaking step denotes the stage in which the proportion of pulp having been supplied to the cavity is from 0 to 30%, preferably 0 to 20%, of the total pulp necessary for completion of a pulp molded article.

According to the present embodiment of the method of producing a pulp molded article, the pulp slurry concentration in the cavity in the initial stage of pulp layer formation in the papermaking step is lower than the predetermined concentration of the first pulp slurry feed. Where, in particular, the predetermined concentration of the first pulp slurry feed is 1% by weight or higher, the pulp slurry concentration pc in the cavity in the initial stage of pulp layer formation in the papermaking step [$\rho c$=amount of pulp in the cavity/(water content of the slurry in the cavity+water content of the diluting fluid in the cavity)] preferably ranges from 16 to $[2500/(25+6\rho s)]$% of the predetermined concentration of the first pulp slurry.

Where the pulp slurry concentration $\rho c$ in the cavity is less than 16%, the largest thickness to smallest thickness ratio (the largest thickness/the smallest thickness) of a molded article would exceed a preferred range of from 1.0 to 3.0. In this case, the pulp layer would suffer from considerable thickness unevenness. It may follow that the pulp layer is scorched on drying, the drying efficiency is reduced, or the resulting molded article has reduced compressive strength. Where the ρc exceeds [2500/(25+6ρs)]%, the requisite injection volume Vw of the diluting fluid is 8 or more times the cavity volume Vc, and the time required for the papermaking step becomes long.

After the first pulp slurry I is injected until the amount of the slurry in the cavity 13 reaches a prescribed amount, dewatering by suction of the pulp slurry through the suction passageways 14 is started. The water content in the first pulp slurry of low concentration is thus discharged out of the papermaking mold 10, and the pulp fiber is deposited on the inner surface of the cavity 13 (i.e., in the inner side of the papermaking screen) to form a first pulp layer 15 as an outermost layer as shown in FIG. 2(*b*). Since a predetermined pressure is applied to the first pulp slurry I of low concentration in the cavity 13 as mentioned above, dewatering through the suction passageways 14 proceeds smoothly, and the pulp fiber is uniformly deposited without thickness unevenness in the vertical direction while being prevented from settling spontaneously. Because the first pulp slurry I is continuously injected while the slurry is sucked through the suction passageways 14, the slurry concentration in the cavity 13 gradually increases over that at the start of pulp layer formation.

After a predetermined amount of the first pulp slurry I has been injected, the valves V1 and V2 are operated so that only a second slurry may be fed from the line B of FIG. 1, and a second pulp slurry II different from the first pulp slurry I in composition is injected under pressure into the cavity 13 through the upper opening of the papermaking mold 10 as shown in FIG. 2(*c*). As a result, there is a mixed slurry of the first pulp slurry and the second pulp slurry in the cavity 13. The injection pressure of the second pulp slurry II can be about the same as that of the first pulp slurry I. By the injection of the second pulp slurry, the pressure in the cavity 13 is maintained.

The second pulp slurry is not particularly limited in concentration as long as it has a different composition from the first one's. Similarly to the first pulp slurry, a preferred concentration is 0.1 to 6% by weight, particularly 0.5 to 3% by weight. At a concentration lower than 0.1% by weight, the pulp slurry can fail to provide a uniform thickness, resulting in unsatisfactory molding. A pulp slurry having a concentration higher than 6% by weight will need an increased amount of a diluting fluid to obtain a desired effect in diluting the pulp slurry in the cavity, which needs an increased time for injecting the diluting fluid.

The pulp fiber which can be used in the second pulp slurry includes any kinds that are used in this type of pulp molded articles. In particular, use of specific pulp fiber as described later provides molded articles with specific characteristics described later. The second pulp slurry may contain, in addition to the pulp fiber and water, other components, such as inorganic substances, e.g., talc and kaolinite, inorganic fibers, e.g., glass fiber and carbon fiber, powdered or fibrous thermoplastic synthetic resins, e.g., polyolefins, non-wood or plant fiber, polysaccharides, and so forth. The amount of these other components is preferably 1 to 70% by weight, particularly 5 to 50% by weight, based on the total amount of the pulp fiber and the other components.

While the second pulp slurry is being injected, the cavity 13 is continuously dewatered by suction through the suction passageways 14, whereby a mixed pulp layer (not shown), which is composed of the components of the mixed slurry, is formed on the first pulp layer 15. Since the proportion of the second pulp slurry to the first pulp slurry in the mixed slurry increases continuously with time, the composition of the mixed layer formed on the first pulp layer 15 varies continuously from the composition of the first pulp slurry to that of the second pulp slurry. Since the cavity 13 is in a pressurized state, the mixed layer is formed with a uniform thickness. In detail, because each pulp slurry is fed under pressure into the cavity 13, a convection flow is generated in the cavity 13 to agitate the pulp slurry even in the production of a three-dimensional hollow molded article with its body steeply upstanding from the bottom as in the present embodiment. Therefore, the pulp slurry concentration is equalized in the vertical direction of the cavity 13 to thereby form the first pulp layer 15, the mixed layer 16, and a second pulp layer 17 each with a uniform thickness.

Then, the concentration of the pulp slurry in the cavity 13 is made lower than the predetermined concentration of the second pulp slurry in the final stage of second pulp layer 17 formation in the papermaking step. In the present embodiment, in particular, the concentration of the pulp slurry in the cavity 13 is made lower than the predetermined concentration of the second pulp slurry while the liquid level in the cavity 13 is falling in order to effectively reduce thickness unevenness in the vertical direction in the final stage of second pulp layer formation thereby providing a uniform thickness.

According to the present embodiment, before injection of a predetermined amount of the second pulp slurry II comes to an end, the valve V1 is operated so that a diluting fluid (fluid for dilution and agitation) may be fed from the line C of FIG. 1, and the diluting fluid is fed under pressure together with the second pulp slurry II so that the pulp slurry concentration in the cavity 13 in the final stage of the second pulp layer formation in the papermaking step is lower than the predetermined concentration of the second pulp slurry.

On completing injection of a predetermined amount of the second pulp slurry II, V1 is operated so that only the diluting fluid may be fed from the line C, and only the diluting fluid continues being injected as shown in FIG. 2(*d*) to lower the pulp slurry concentration in the cavity 13 than the predetermined concentration of the second pulp slurry in the final stage of second pulp layer formation in the papermaking step. The second pulp slurry remaining in the cavity 13 is thus diluted and agitated by feeding the diluting fluid, and continuation of dewatering through the suction passageways 14 results in uniform formation of the second pulp layer 17, an innermost layer, as a deposit of the component of the second pulp slurry, on the mixed layer. In this case, too, since the pulp slurry in the cavity 13 is being diluted and agitated by the injected diluting fluid, the second pulp layer 17 is formed with a uniform thickness. Further, since the diluting fluid is fed under pressure, dewatering through the suction passageways 14 proceeds satisfactorily to give a satisfactory finish to the inner side.

According to the present embodiment, in particular, water, warm water, etc. injected as a diluting fluid also serves to wash away the second pulp slurry remaining in the pipe line. As a result, when a papermaking is started again from scratch, only the first pulp slurry can be fed, and deposition of the second pulp on the outer surface of a molded article is avoided.

It is possible to start injection of the diluting fluid after completion of the injection of the second pulp slurry II while the second pulp slurry remains in the cavity.

As described above, in the production of a pulp molded article according to the present embodiment, the pulp slurry concentration in the cavity is made lower than the predetermined concentration of the second pulp slurry in the final stage of pulp layer formation in the papermaking step. The term "final stage" of pulp layer formation in the papermaking step denotes the stage in which the proportion of pulp having been fed into the cavity is from 70 to 100%, preferably 80 to 100%, of the total pulp fibers necessary to complete a pulp molded article.

In the production of a pulp molded article according to the present embodiment, the pulp slurry concentration in the cavity in the final stage of pulp layer formation in the papermaking step is preferably 16 to 18% of the predetermined concentration of the second pulp slurry.

The volume of the diluting fluid to be injected in the final stage of pulp layer formation is decided appropriately according to the size and the shape of a molded article to be produced (or the cavity volume) and the predetermined concentration of the second pulp slurry. Where the predetermined concentration of the second pulp slurry is 1% by weight or higher, a preferred injection volume Vw of the diluting fluid is in the range $(1/4)\rho s \cdot Vw < 8Vc$. If the injection volume Vw of the diluting fluid is $(1/4)\rho s \cdot Vc$ or less, the largest thickness to smallest thickness ratio (the largest thickness/the smallest thickness) of a molded article would exceed a preferred range of from 1.0 to 3.0, i.e., the pulp layer would suffer from considerable thickness unevenness. If the injection volume Vw of the diluting fluid is 8 or more times the cavity volume Vc, a long time is required for completion of papermaking step.

On forming a prescribed pulp layer, injection of the diluting fluid is stopped, and dewatering is performed. In the step of dewatering as shown in FIG. 2(*e*), a hollow, elastically stretchable pressing member 18 is inserted into the cavity 13 while the cavity 13 is in suction. The pressing member 18 is used in its inflated state in the cavity 13 like a balloon to press the laminate consisting of the first pulp layer 15, the mixed layer 16, and the second pulp layer 17 (hereinafter referred to as a pulp preform) onto the inner surface of the cavity 13 thereby to transfer the inside profile of the cavity 13 to the preform. Accordingly, the pressing member 18 is made of urethane, fluororubber, silicone rubber, elastomers, etc., which are excellent in tensile strength, impact resilience, and stretchability.

A pressurizing fluid is then fed into the pressing member 18 to expand it as shown in FIG. 2(*f*). The pulp preform is thus pressed toward the inner wall of the cavity 13 by the expanded pressing member 18. As the pulp preform is pressed to the inner wall of the cavity 13 by the expanded pressing member 18, the inside profile of the cavity 13 is transferred to the pulp preform and, at the same time, dewatering proceeds further. Since the pulp preform is pressed from its inside against the inner wall of the cavity 13, the inner profile of the cavity 13 is transferred to the pulp preform with good precision however complicated the inner profile may be. Besides, because there is no step of coupling separately formed parts unlike a conventional method of producing pulp moldings, the resulting molded article has no seams nor thick-walled parts due to coupling. As a result, the resulting molded article has secured strength and a satisfactory appearance. The pressurizing fluid for expanding the pressing member 18 includes compressed air (heated air), oil (heated oil) and other liquids. The pressure for feeding the pressurizing fluid is preferably 0.01 to 5 MPa, particularly 0.1 to 3 MPa.

After the profile of the inner wall of the cavity 13 is sufficiently transferred to the pulp preform, and the pulp preform is dewatered up to a prescribed water content, the pressurizing fluid is withdrawn from the pressing member 18 as shown in FIG. 2(*g*), whereupon the pressing member 18 shrinks automatically to its original size. The shrunken pressing member 18 is taken out of the cavity 13, and the papermaking mold 10 is opened to remove the wet pulp preform 19 having the prescribed water content.

The pulp preform 19 is then subjected to the step of heat drying. In the heat drying step, the same operation as in the papermaking step shown in FIG. 2 is conducted, except that papermaking and dewatering are not carried out. Firstly, a heating mold, which is a set of splits joined together to form a cavity in conformity to the outer contour of a molded article to be produced, is heated to a prescribed temperature, and the wet pulp preform is fitted therein.

Secondly, a pressing member similar to the pressing member 18 used in the papermaking step is put into the pulp preform, and a pressurizing fluid is fed into the pressing member to expand it, whereby the pulp preform is pressed onto the inner wall of the cavity by the expanded pressing member. The material of the pressing member and the pressure for feeding the pressurizing fluid can be the same as those used in the papermaking step. In this state, the pulp preform is dried by the heat. After the pulp preform dries sufficiently, the pressurizing fluid is withdrawn from the pressing member, and the shrunken pressing member is taken out. The heating mold is opened to remove the resulting molded article.

In the present embodiment, a diluting fluid is injected into the cavity in the initial stage and the final stage of pulp layer formation, particularly while the amount of the pulp slurry is increasing in the initial stage and while it is decreasing in the final stage, to lower the pulp slurry concentration in the cavity than the predetermined concentration of the first or the second pulp slurry. As a result, the solid ingredients in the slurry do not precipitate and a molded article free from vertical unevenness in thickness can be formed. Since the first pulp slurry I and the second pulp slurry II are fed into the cavity 13 in a continuous manner, a molded article having a multilayer structure in its thickness direction can be produced efficiently. Where water is injected as a diluting liquid after completion of injection of the second pulp slurry, the second pulp slurry is expelled by the water from the line D of FIG. 1. Therefore, when a next molding cycle is commenced, a papermaking operation can be started immediately.

As depicted in FIG. 2(*h*), the molded article 1 thus produced is a cylindrical bottle (hollow container) having a smaller diameter in the opening 2 than in the body 3, which is especially suited to hold powder, particles, etc. The molded article 1 is an integrally molded shape with no seams on any of the opening 2, the body 3, and the bottom 4 and thus exhibits increased strength and a satisfactory outer appearance.

Figure 3:
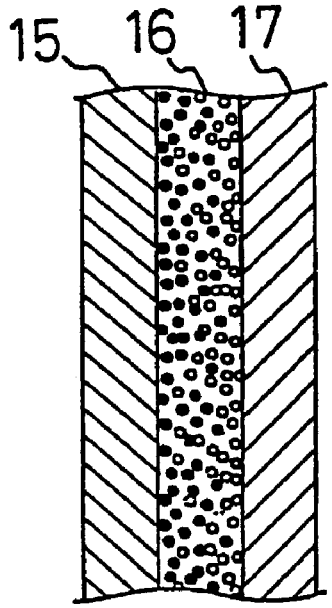
FIG. 3 is a schematic showing a multilayer structure of a molded article produced by the present invention.

The multilayer structure of the molded article produced by the present embodiment is as shown in FIG. 3. Between the first pulp layer 15 as an outermost layer and the second pulp layer 17 as an innermost layer, there is formed the mixed layer 16 of which the composition varies continuously from the composition of the first pulp layer to that of the second pulp layer. The mixed layer 16 provides increased adhesive strength between the first pulp layer 15 and the second pulp layer 17, with which separation of these two layers is effectively prevented. Formation of the mixed layer 16 between the first pulp layer 15 and the second pulp layer 17 can be confirmed by observation of microscope.

Each thickness of the first pulp layer 15, the mixed layer 16, and the second pulp layer 17 is decided appropriately according to the use of the molded article. It is preferred for the outermost layer (the first pulp layer 15 in the present embodiment) to have a thickness of 5 to 90%, particularly 10 to 70%, especially 10 to 50%, of the total thickness of the molded article. With this outer layer thickness range, sufficient hiding capabilities are exhibited when seen from the outside even where the inner layer is made of pulp fiber of low whiteness; the inner layer is hardly exposed even where the outermost layer is scratched; and the inner layer exhibits sufficient properties of covering the inside of the molded article. The thickness of each layer depends on the amounts and the concentrations of the first and second pulp slurries.

Having the multilayer structure, the individual layers can have different functions. For example, only the first pulp layer 15 as the outermost layer can be rendered colored by incorporating a colorant, such as a pigment or a dye, or colored traditional Japanese paper or a colored synthetic fiber into the first pulp slurry. Incorporating the colorant only into the first pulp slurry is advantageous in that the tone of that slurry can be adjusted with ease in case where pulp having a relatively high whiteness, for example, pulp obtained from used paper, such as de-inked pulp, is compounded into the first pulp slurry (e.g., to a whiteness of 60% or more, particularly 70% or more). The amount of the colorant to be added is preferably 0.1 to 15% by weight based on the pulp fiber.

The first or the second pulp slurry can contain pulp fiber having a weighted-average fiber length of 0.8 to 2.0 mm, a Canadian Standard Freeness of 100 to 600 cc, and such distribution of fiber length as comprises 20 to 90%, based on the total fiber, of fibers whose length ranges from 0.4 mm to 1.4 mm and 5 to 50%, based on the total fiber, of fibers whose length is longer than 1.4 mm and not longer than 3.0 mm. In this case, the first pulp layer 15 or the second pulp layer 17 will have an extremely uniform thickness. Particularly where the first pulp slurry contains hard wood bleached pulp (LBKP) and comprises pulp fiber having a weighted-average fiber length of 0.2 to 1.0 mm) a Canadian Standard Freeness of 50 to 600 cc, and such a distribution of fiber length as comprises 50 to 95%, based on the total fiber, of fibers whose length ranges from 0.4 mm to 1.4 mm, the resulting molded article will have improved surface smoothness and suitability to printing or coating.

The term "weighted-average fiber length" as used herein is a value obtained by measuring a distribution of pulp fiber length and calculating a weighted average from the distribution. Measurement was made with a fiber length analyzer Kajaani FS-200 (manufactured by Valmet Automation Company). The fiber count was set at 20,000 or more.

Incorporating additives, such as water-proofing agents, water repellents, vapor-proofing agents, fixing agents, antifungal agents, antistatic agents, and the like, into the first pulp slurry imparts the respective functions to the first pulp layer 15. It is preferred for the first pulp layer 15 containing these additives as the outermost layer to have a surface tension of 10 dyn/cm or less and a water repellency of R10 (JIS P 8137). Further, incorporating a particulate or fibrous thermoplastic synthetic resin to the first pulp slurry imparts abrasion resistance to the first pulp layer 15 to suppress fluffing and the like. The degree of abrasion resistance is preferably 3H or higher in terms of pencil hardness (JIS K 5400).

According to the present embodiment, a desired characteristic of a certain additive or pulp fiber can thus be manifested by incorporating such an additive, etc. into only a specific layer where the characteristic is to be manifested more efficiently. This provides an advantage that the amount of the additive, etc. can be minimized compared with the amount as required for a single-layered pulp molded article.

The present invention is not limited to the above-described embodiment. For example, while in the above embodiment the pulp slurries and the diluting fluid are fed into the cavity through the piping system shown in FIG. 1, each of the pulp slurries and the diluting fluid may be separately fed to the cavity through the individual pipe lines.

The means for lowering the pulp slurry concentration in the cavity in the initial stage or the final stage of pulp layer formation in the papermaking step is not limited. For example, a pulp slurry having a low concentration may be fed in the initial stage of pulp layer formation and then switched over to a pulp slurry having a normal concentration (the set concentration) when a predetermined feed amount is reached. Likewise a switch-over may be made from a pulp slurry having a normal concentration (set concentration) to a pulp slurry having a lower concentration in the final stage of pulp layer formation.

In order to increase the suction and dewatering efficiency, warm water can be used for a fluid of the pulp slurries. In this case, warm water of 35 to 90° C. is preferable, particularly 45 to 80° C. is preferable, is more preferable.

The method of producing a pulp molded article according to the present invention is applicable to the manufacture of molded articles having a single-layer structure or a three- or more-layered multilayer structure.

Figure 4A:
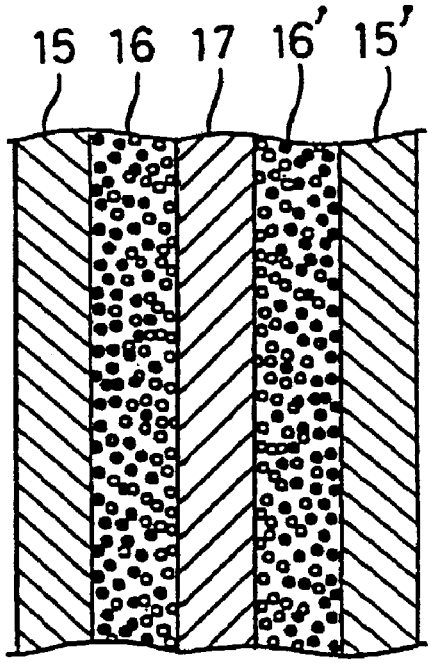
FIG. 4A and FIG. 4B are schematics (corresponding to FIG. 3) showing other multilayer structures of a molded article produced by the present invention.
Figure 4B:
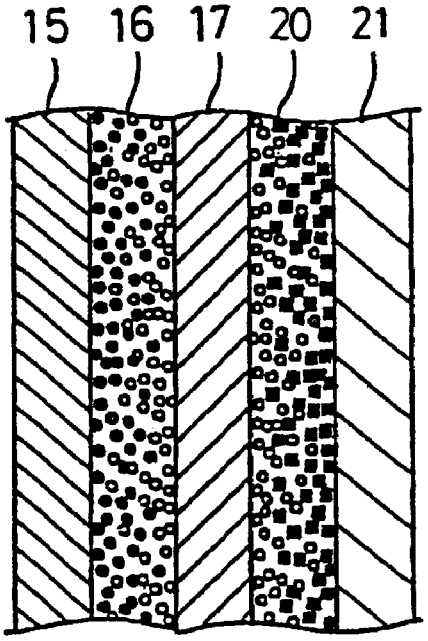

For example, the method is applicable to the manufacture of a molded article having the layer structure shown in FIG. 3. It is also applicable to the manufacture of a molded article having the structure shown in FIG. 4(*a*), in which another first pulp layer 15' is formed on the side of the second pulp layer 17 shown in FIG. 3, and a mixed layer 16' whose composition continuously varies from the composition of the second pulp layer 17 to that of the first pulp layer 15' is formed between the second pulp layer 17 and the first pulp layer 15', thereby making up a 5-layered structure of which the innermost layer and the outermost layer have the same composition. In this embodiment, the first pulp layers 15 and 15' may be made of pulp having a high degree of whiteness, while the second pulp layer 17 may be made of pulp having a low degree of whiteness, such as pulp of used paper, to provide a molded article which has a highly white appearance and a low price. It is also possible that a third pulp layer 21 different in composition from either of the second pulp layer 17 and the first pulp layer 15 is formed on the side of the second pulp layer 17 shown in FIG. 3, and a mixed layer 20 whose composition continuously varies from the composition of the second pulp layer 17 to that of the third pulp layer 21 is formed between the second pulp layer 17 and the third pulp layer 21 thereby making up a layer structure having 5 layers in total as shown in FIG. 4(*b*). In this case, a multilayer molded article has different materials in each layer. In the production of molded articles having a single-layer or a three- or more-layer structure, too, the concentrations of the pulp slurries fed into the cavity are preferably set within a range of 0.1 to 6% by weight, particularly 0.5 to 3% by weight.

After the papermaking step, a plastic layer, a coating layer, and the like may be provided on the outer side and/or the inner side of the molded article to enhance the strength of the molded article or to prevent leakage of the contents, or for the purpose of decoration.

A reinforcing member made of plastics, etc. may be applied on the portion of the molded article to which a load is imposed, (for example, the opening or the bottom portion.) Otherwise, a part of these portions may be formed of plastics, etc.

The present invention is also applicable to the production of substantially rectangular parallelepipedal cartons of which the opening and the body have substantially the same cross-sectional contour.

The present invention is applicable to the production of not only hollow containers for keeping things in but various shapes such as ornaments.

Where two or more kinds of pulp slurries having different compositions are injected into the cavity in succession, each followed by suction dewatering through the suction passageways of the papermaking mold, pulp layers made of the solid component of each pulp slurry can be formed successively without forming a mixed layer. While a pulp slurry is being injected, dewatering may be carried out merely by drainage through an opened drain valve. In this case, the slurry is dewatered by suction after completion of the injection of the pulp slurry. The dewatering using the pressing member may be replaced with aeration dewatering by feeding air, steam, etc. from the inside of the molded article.

The present invention is suited to the method in which splits having suction passageways are assembled into a papermaking mold, and a pulp slurry is injected downward into the cavity of the mold as in the aforementioned embodiment. The present invention is also applicable to a method in which a split of the papermaking mold having suction passageways is placed with its papermaking surface up, and an outer frame surrounding at least the papermaking surface of the split is set up to form a space, in which a prescribed amount of a pulp slurry is poured and sucked through the suction passageways to form a molded article on the papermaking surface.

In Examples 1 to 4 and Comparative Example 1, molded articles were produced by using the papermaking mold and the feed system shown in FIG. 1. Test pieces were cut out of the resulting molded articles, and an average thickness, the largest thickness, the smallest thickness, the largest to the smallest thickness ratio, and a compressive strength (maximum strength) of the test pieces were measured. The results are shown in Table 1. Table 1 also furnishes the injection volume and the injection time of the diluting fluid (water) in Examples and Comparative Examples.

EXAMPLE 1

Figure 5:
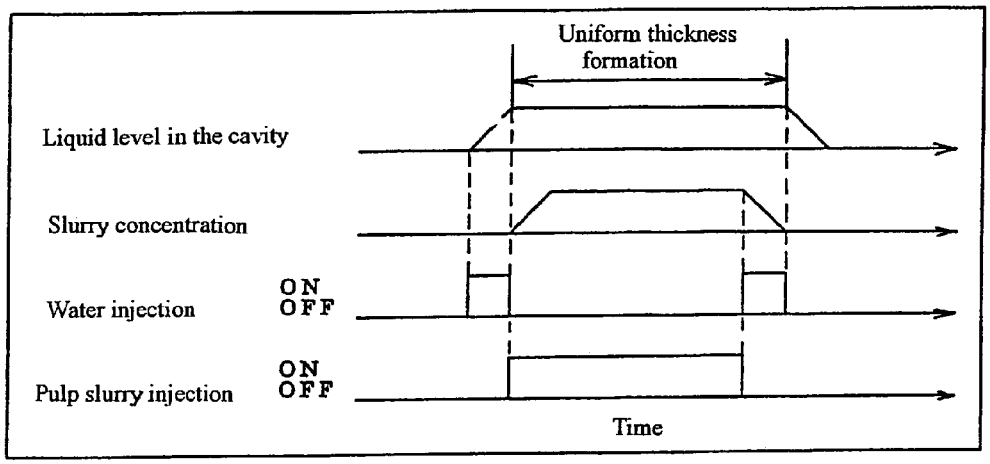
FIG. 5 is a schematic chart of the papermaking step in time sequence in Examples of the present invention.

A molded article was produced by using a pulp slurry having the composition described later. Water was injected to dilute the pulp slurry in the cavity in the initial stage and the final stage of pulp layer formation in the papermaking step according to the time chart shown in FIG. 5.

Prior to injecting the pulp slurry, 0.5 liter (0.25 l/sec) of ambient temperature water (tap water at 5 to 20° C., hereinafter the same) as a diluting fluid was injected into the cavity (capacity: 1 liter). The pulp slurry was fed under a pressure of 0.1 MPa. The cavity was then sucked through the suction passageways to dewater the pulp slurry and deposit pulp on the papermaking surface. After 4.5 liters of the pulp slurry was injected, 0.5 liter (0.25 l/sec) of ambient temperature water was injected into the cavity as a diluting fluid. A pressing member made of an elastic material was inserted into the resulting pulp preform, and air was introduced into the pressing member under a pressure of 0.3 MPa to press the pulp preform onto the inner wall of the cavity to further dewater the preform.

The papermaking mold was opened to take out the pulp preform, which was fitted into a drying mold having the same inner profile as the papermaking mold. A pressing member made of an elastic member was inserted into the pulp preform fitted in the drying mold, and air was introduced into the pressing member under a pressure of 1 MPa thereby to press the pulp preform to the inner wall of the cavity. In this state, the drying mold was heated to 220° C. to dry the pulp preform. After the pulp preform dried sufficiently, the drying mold was opened to take out a bottle-shaped molded article.

TABLE 1

| | | Example | | | | Comparative Example | |
|---|---|---|---|---|---|---|---|
| | | 1 | 2 | 3 | 4 | 1 | 2 |
| Water for initial stage dilution | Volume (l) | 0.5 | 1.25 | 2.5 | 5.0 | 0 | 0.25 |
| | Time (sec) | 2 | 5 | 10 | 20 | 0 | 1 |
| Water for final stage dilution | Volume (l) | 0.5 | 1.25 | 2.5 | 5.0 | 0 | 0.25 |
| | Time (sec) | 2 | 6 | 10 | 20 | 0 | 1 |
| Average thickness (mm) | | 0.68 | 0.63 | 0.63 | 0.61 | 0.70 | 0.73 |
| Largest thickness (mm) | | 1.07 | 0.85 | 0.88 | 0.82 | 1.17 | 1.30 |
| Smallest thickness (mm) | | 0.39 | 0.39 | 0.44 | 0.46 | 0.38 | 0.38 |
| Largest/smallest thickness ratio | | 2.74 | 2.15 | 2.02 | 1.78 | 3.09 | 3.42 |
| Compressive strength (N) | | 431 | 474 | 451 | 491 | 301 | 297 |

Composition of pulp slurry:
Liquid component: water
Solid component: 7:3 (by weight) pulp mixture of deinked paper (DIP) and NBKP
Set concentration of pulp slurry feed: 1 wt %.

EXAMPLES 2 to 4

Molded articles were produced in the same manner as in Example 1, except for changing the injection volume and injection time of water as a diluting fluid in the papermaking step as shown in Table 1.

COMPARATIVE EXAMPLE 1

A molded article was produced in the same manner as in Example 1, except that water was not injected, and the pulp slurry was not diluted.

Evaluation of Thickness Unevenness

The thickness of the upright wall (except the threaded part) of the molded article was measured at 8 positions selected in the vertical direction with a micrometer. The thickness unevenness was evaluated from the largest thickness, the smallest thickness, and the largest to the smallest thickness ratio.

Measurement of Compressive Strength

A cylindrical member having a screw thread on its outer peripheral surface was press fitted over the neck of the resulting bottle-shaped molded article. The molded article was filled with 79 g of a powder (Trade name: Funmatsu Wide Hiter, a production of Kao Corp.), and a cap was screwed on. The molded article and the contents were set on a compressive strength measuring instrument (RTA-500, supplied by Orientec Company), and the compressive strength was measured at a cross head speed of 20 mm/min.

As is apparent from the results shown in Table 1, it was confirmed that the molded articles prepared in Examples 1 to 4 (the products of the present invention) have smaller thickness unevenness in the vertical direction and higher compressive strength than those of Comparative Example 1.

INDUSTRIAL APPLICABILITY

According to the present invention, a pulp molded article with reduced thickness unevenness in the vertical direction can be produced.

The invention claimed is:

1. A method of producing a pulp molded article which includes a papermaking step comprising:

joining splits each having suction passageways into a papermaking mold thereby forming a cavity;

feeding into the cavity a first fluid for diluting a pulp slurry before the pulp slurry is in the cavity;

feeding the pulp slurry into the cavity;

sucking the pulp slurry through the suction passageways to form a pulp layer on the inner surface of the papermaking mold; and lowering a concentration of the pulp slurry in the cavity during pulp layer formation.

2. The method of producing a pulp molded article according to claim 1, further comprising:

feeding a second fluid for diluting said pulp slurry into said cavity after completion of feeding the pulp slurry into the cavity.

3. The method of producing a pulp molded article according to claim 1, wherein the feeding the pulp slurry into the cavity of the papermaking mold includes feeding at least two pulp slurries different in composition, the start of feeding the first pulp slurry of said pulp slurries being followed by feeding the second pulp slurry of said pulp slurries.

4. The method of producing a pulp molded article according to claim 1, further comprising:

feeding the first fluid for diluting said pulp slurry through a pipe system for feeding said pulp slurry.

5. A method of producing a pulp molded article which includes a papermaking step comprising joining splits each having suction passageways into a papermaking mold, feeding a pulp slurry into the cavity of the papermaking mold, and sucking the pulp slurry through the suction passageways to form a pulp layer on the inner surface of the papermaking mold, wherein at least two pulp slurries of different composition are fed into the cavity, the start of feeding the first pulp slurry of said pulp slurries is followed by feeding the second pulp slurry of said pulp slurries, and a fluid for dilution and agitation is fed into the cavity.

6. A method of producing a pulp molded article, the method comprising:

joining a first split and a second split, thereby forming a cavity;

feeding a first diluting fluid into the cavity;

feeding a first pulp slurry into the cavity; and sucking the first pulp slurry through suction passageways formed in at least one of the first split and the second split to form a first pulp layer, wherein a concentration of the first pulp slurry is greater than a concentration of the first diluting fluid.

7. A method of producing a pulp molded article, the method comprising:

joining a first split and a second split, thereby forming a cavity;

feeding a first diluting fluid into the cavity;

feeding a first pulp slurry into the cavity; and sucking the first pulp slurry through suction passageways formed in at least one of the first split and the second split to form a first pulp layer, wherein a concentration of the first pulp slurry is greater than a concentration of the first diluting fluid, and a volume of the first diluting fluid is in the range of:

$$(1/4)(\rho s)\cdot V_c<V_w<8V_c,$$

where $V_w$ is a volume of the first diluting fluid, $V_c$ is a volume of the cavity, and ρs is a weight percentage (concentration) of the first pulp slurry.

8. A method of producing a pulp molded article, the method comprising:

joining a first split and a second split, thereby forming a cavity;

feeding a first diluting fluid into the cavity;

feeding a first pulp slurry into the cavity;

sucking the first pulp slurry through suction passageways formed in at least one of the first split and the second split to form a first pulp layer;

feeding a second pulp slurry into the cavity;

feeding a second diluting fluid into the cavity; and sucking the second pulp slurry through suction passageways formed in at least one of the first split and the second split to form a second pulp layer, wherein a concentration of the first pulp slurry is greater than a concentration of the first diluting fluid.

9. The method of claim 8, wherein a volume of the second diluting fluid is in the range of:

$$(1/4)(\rho s)\cdot V_c<V_w<8V_c,$$

where $V_w$ is a volume of the second diluting fluid, $V_c$ is a volume of the cavity, and ρs is a weight percentage (concentration) of the second pulp slurry.

10. A method of producing a pulp molded article, the method comprising:

joining a first split and a second split, thereby forming a cavity;

feeding a first diluting fluid into the cavity;

feeding a first pulp slurry into the cavity;

feeding a second diluting fluid into the cavity after feeding the first pulp slurry into the cavity; and sucking the first pulp slurry through suction passageways formed in at least one of the first split and the second split to form a first pulp layer, wherein a concentration of the first pulp slurry is greater than a concentration of the first diluting fluid.

11. The method of claim 10, wherein a volume of the second diluting fluid is in the range of:

$$(1/4)(\rho s)\cdot V_c<V_w<8V_c,$$

where $V_w$ is a volume of the second diluting fluid, $V_c$ is a volume of the cavity, and ρs is a weight percentage (concentration) of the first pulp slurry.

* * * * *